United States Patent [19]

Schuster et al.

[11] 4,232,420

[45] Nov. 11, 1980

[54] SCOURING PAD HANDLE

[76] Inventors: Sam Schuster; Lilian E. Schuster, both of 2625 Pirineos Way, Apt. #124, La Costa, Calif. 92008

[21] Appl. No.: 32,529

[22] Filed: Apr. 23, 1979

[51] Int. Cl.[3] ..... A47K 7/02; A47L 13/46

[52] U.S. Cl. ..... 15/209 D; 15/244 R; 16/114 R

[58] Field of Search ..... 15/209 B, 209 D, 244 R; 16/110 R, 110.5, 114 R, 114 A; 81/177; 7/167; 269/8

[56] References Cited

U.S. PATENT DOCUMENTS

| | | | |
|---|---|---|---|
| 1,603,175 | 10/1926 | Weisz | 15/209 D |
| 2,140,578 | 12/1938 | Goodloe | 15/209 B |
| 3,060,478 | 10/1962 | Silver | 15/209 D |
| 3,226,888 | 1/1966 | Erenyi | 269/8 |
| 3,253,626 | 5/1966 | Stillwagon, Jr. et al. | 81/177 X |

*Primary Examiner*—Leonard D. Christian
*Attorney, Agent, or Firm*—Brown & Martin

[57] ABSTRACT

A scouring pad handle includes a body member of a generally box like configuration having a magnet mounted therein and a handle extending from the other end to be grasped by the hand. The magnet is adapted to magnetically secure metallic scouring pads directly to the handle.

5 Claims, 3 Drawing Figures

SCOURING PAD HANDLE

BACKGROUND OF THE INVENTION

The present invention relates to handles and pertains particularly to a detachable handle for metallic scouring pads.

Scouring pads are quite extensively used in the scrubbing and scouring of pots and pans and the like. Such pads are typically grasped in the hand and can be uncomfortable and injurious to the hands, particularly where steel wool and the like is used. Many suggestions for alleviating this problem have included the provision of handles which secure to the pad. These handles typically utilize bolts and nuts or similar devices for securing the pad to the handle. Such devices, however, have a number of drawbacks, including the difficulty of attaching and detaching of the pad requiring the removal and replacement of nuts, each time a pad is replaced. Moreover, the nuts and bolts can themselves extend beyond the pad, and scratch or marr the surface of utensils and the like.

Typical of the approaches to solving the above problems are found in the following patents, which illustrate the prior art approach:

U.S. Pat. No. 1,715,974, issued June 4, 1929 to Andrieu and directed to a brush. This patent discloses a handle and the like combination which is adapted to connect to a brush or steel wool pad. The device includes a plurality of pads or the like 6 which are adapted to engage or support the body member on the floor. The steel wool pads are placed in and forced down through the body into engagement with the floor.

The Darling Patent, U.S. Pat. No. 1,820,183, issued Aug. 25, 1931, discloses a scouring device wherein a handle having a metal disc with a plurality of prongs extending downward and are clipped to, or engage the pad of steel wool.

The Silver patent, U.S. Pat. No. 3,060,478, issued Oct. 30, 1962, discloses a scouring device wherein special scrubbing pads are provided having a hole in the center thereof which is engaged by a disc which is detachably connectable to a circular handle member by a bolt-like device.

The Garrett patent, U.S. Pat. No. 3,090,064, issued May 21, 1963, discloses a handle for scouring pads in which a plurality of sharp prongs extend outward and parallel to the face of a disc and is rotated to engage the prongs into a pad of steel wool or the like.

The Kroll patent, U.S. Pat. No. 3,947,915, is directed to steel wool pads and holder therefor, wherein a holder member includes a wire retaining member that has a generally oval configuration and extends upward for pressing a pair of pads against a backing member for securing them into place on a handle. None of these patents disclose or suggest the applicant's specific arrangement or concept.

It is therefore desirable that some means be provided which overcome the problems of the prior art.

SUMMARY AND OBJECTS OF THE INVENTION

It is accordingly the primary object of the present invention to overcome the above problems of the prior art.

Another object of the present invention is to provide a quickly and easily detachable handle for scouring pads and the like.

Another object of the present invention is to provide a scouring pad handle that eliminates the need for nuts and bolts and the like.

In accordance with the primary aspect of the present invention a handle for a scouring pad includes a magnet with a hand grasping handle extending outward therefrom, with the magnet detachably connecting the handle directly to scouring pads of the type having a substantial portion thereof of a magnetically attractable material.

BRIEF DESCRIPTION OF THE DRAWING

The above and other objects and advantages of the present invention will become apparent from the following description when read in conjunction with the drawing, wherein.

DETAILED DESCRIPTION OF A PREFERRED EMBODIMENT

Figure 1:
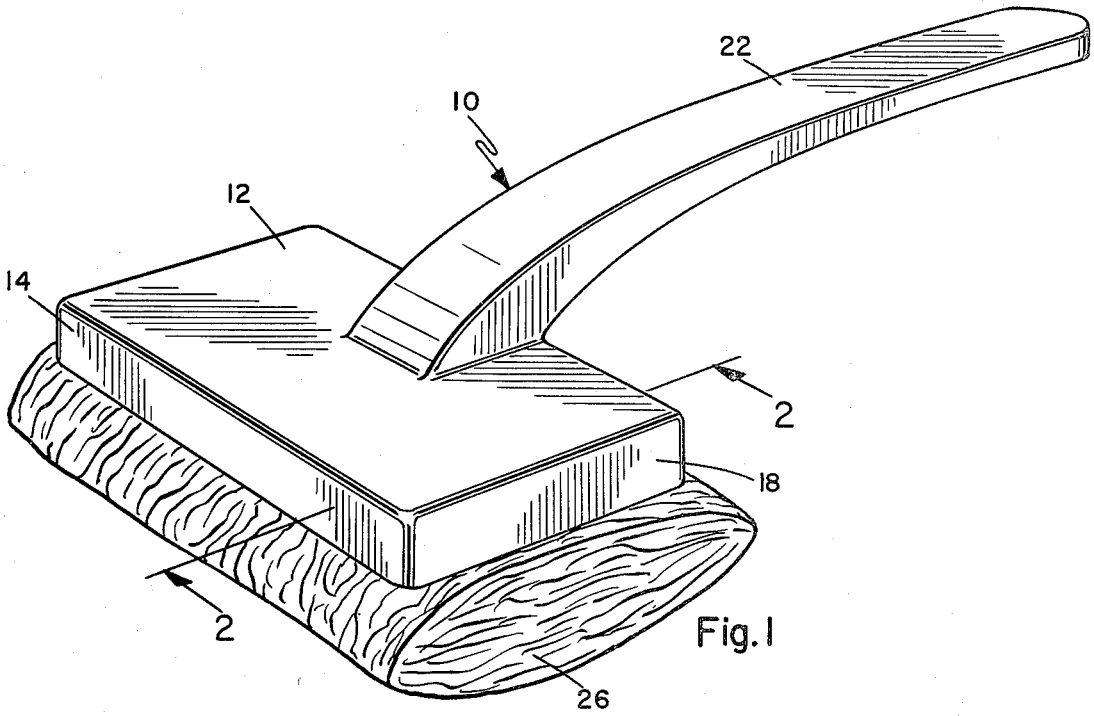
FIG. 1 is a perspective view of a holder with a scouring pad attached.
Figure 2:
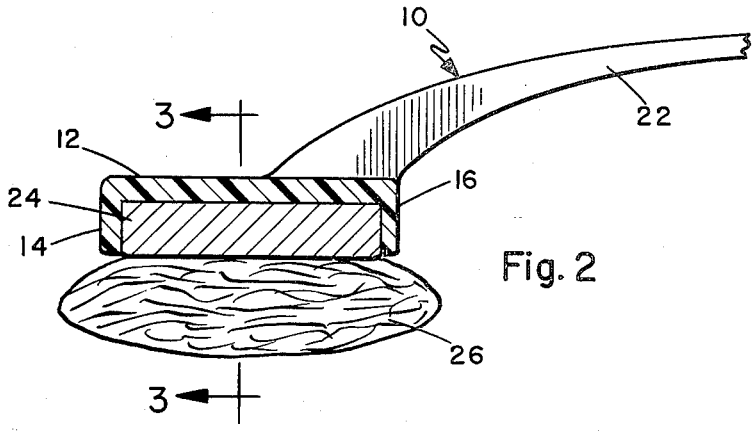
FIG. 2 is a sectional view taken on line 2—2 of FIG. 1.

Turning now to FIG. 1 of the drawing there is illustrated a handle assembly in accordance with the present invention designated generally by the numeral 10. This pad handle assembly comprises a body member 12 of a generally rectangular open box-like configuration normally disposed in the inverted position. As best seen in FIG. 2 the body member includes downwardly projecting sides in the form of side walls 14, 16 and end walls 18 and 20 which define a box like cavity in the body member. A handle 22, in this instance, of a generally elongated configuration extends outward from the upper surface at an angle to the body member portion 12. It should be noted that substantially any form of handle can be attached to the body member 12 and be of substantially any length. The handle is preferably attached to the top, although it can be attached to and extend outward from a side or end.

For illustrative purposes a conveniently shaped and sized handle 22 is disclosed which is convenient for use in scouring pots and pans and the like. This permits the pad to be immersed in water and the like without getting the hands wet and also provides a convenient side to be easily manipulated. The handle and body members may be made of any suitable material such as wood, metal, plastic or the like. The preferred material is a heat and water resistant plastic that can withstand very hot water.

Figure 3:
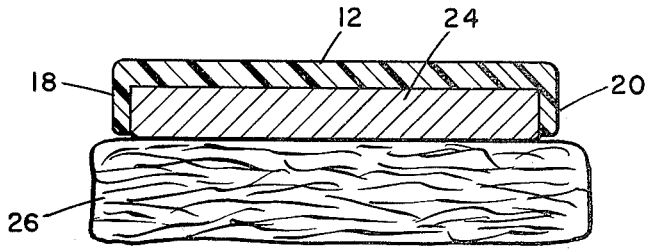
FIG. 3 is a sectional view taken on line 3—3 of FIG. 2.

As best seen in FIGS. 2 and 3, magnet 24 disposed and mounted within the body member 12 for attracting and securing a scouring pad 26 thereto. This magnet 24 is of a size to substantially fill the cavity within the body member.

The body member is preferably of a size to almost but not quite cover the top of a standard size scouring pad of the metallic type. With this arrangement, a metallic or substantially metallic pad 26 having at least a substantial portion thereof of a magnetically attracting metallic material is attracted to the magnet 24 and becomes attached thereto upon close contact. This connects the scouring pad 26 to the handle assembly with sufficient force to enable the effective scouring of pots and pans and the like with the pad and handle combination. Pads can be quickly and easily attached and detached from the handle. The body member and magnet can, of course, be large enough to mount a plurality of pads.

While any form of magnets may be used and while any number of them may be utilized the illustrated form contemplates a single plastic type magnetic member having a fairly large area of contact with the scouring pad. Magnets having a body constructed or formed of magnet in particles embedded in a plastic material are available on the market. This arrangement reduces the detrimental effect of water which may cause rusting of iron type magnets and the like. A large area magnet would also tend to provide greater holding power.

The magnet can be easily and conveniently secured within the body of the handle member by any suitable means such as a glue or other form of adhesive or by screws or the like.

In use of the present invention, scouring pads of the metallic type commonly referred to as steel wool may be utilized. The handle is simply placed on top of the pad and the magnet attracts the pad to the magnet with such force as to retain the pad to the magnet and the handle. The handle 22 can then be grasped in the hand and the pad engages the surface to be scoured and a back and forth motion and suitable force is applied to the pad. When it is desired to replace a pad, the pad is simply grasped in the hand and pulled away from the magnet in the handle. A new pad is then held or placed next to the magnet and is drawn to it.

While numerous changes and modifications may be made in the construction of the illustrated device, it is to be understood that such changes and modifications may be made without departing from the spirit and scope of the invention as defined in the appended claims.

Having described our invention, we now claim:

1. A detachable handle for scouring pads of the type constructed at least in part of magnetically attracting material the improvement in said handle comprising:

a generally box like body portion having a downwardly opening cavity adapted to receive and mount a magnet;

a water immersible permanent magnet mounted in said cavity of said body portion; and a handle member adapted to be grasped by the hand of an individual secured to said body portion and extending upward and outward therefrom.

2. The detachable handle of claim 1, wherein said handle member is secured to said body portion on the opposite side from said cavity.

3. The detachable handle member of claim 2, wherein said handle is elongated and having one end connected to said body portion and the other end extending away from said body portion at an angle.

4. The detachable handle of claim 1, wherein said magnet is made of a plastic material.

5. The handle of claim 1, wherein said body member and said handle member are constructed of magnetic particles embedded in a heat and water resistant plastic.

* * * * *